United States Patent [19]

Smura

[11] 4,115,236

[45] Sep. 19, 1978

[54] CELL CONNECTOR FOR BIPOLAR ELECTROLYZER

[75] Inventor: B. Bernard Smura, Marcellus, N.J.

[73] Assignee: Allied Chemical Corporation, Morris Township, Morris County, N.J.

[21] Appl. No.: 856,382

[22] Filed: Dec. 1, 1977

[51] Int. Cl.[2] ..... C25B 1/24; C25B 9/02

[52] U.S. Cl. ..... 204/254; 204/252; 204/255; 204/279

[58] Field of Search ..... 204/252, 279, 254, 258, 204/268, 286, 270, 256

[56] References Cited

U.S. PATENT DOCUMENTS

| | | | |
|---|---|---|---|
| 3,511,766 | 5/1970 | Kisner et al. | 204/279 |
| 3,884,781 | 5/1975 | Bouy et al. | 204/279 X |
| 3,915,833 | 10/1975 | Michalek et al. | 204/279 X |
| 3,970,539 | 7/1976 | Collins et al. | 204/254 |

*Primary Examiner*—Arthur C. Prescott
*Attorney, Agent, or Firm*—Anthony J. Stewart

[57] ABSTRACT

A cell connector for insuring direct electrical communication and positive mechanical connection with a cell in a bipolar permselective membrane electrolyzer, and which precludes fluid or gaseous flow therefrom, is comprised of an electrically nonconductive cell web, an electrically conductive insert disposed in an aperture in the web, an electrode boss bearing a cell electrode on one face and disposed adjacent the insert at a second face defining an electrode interface, an electrically conductive fastener disposed through a bore in the insert and received in mating engagement with the electrode boss for providing an axial compressive force at the electrode interface, and a biasing member in operative engagement with the fastener for providing a force in opposition to the axial compressive force.

10 Claims, 7 Drawing Figures

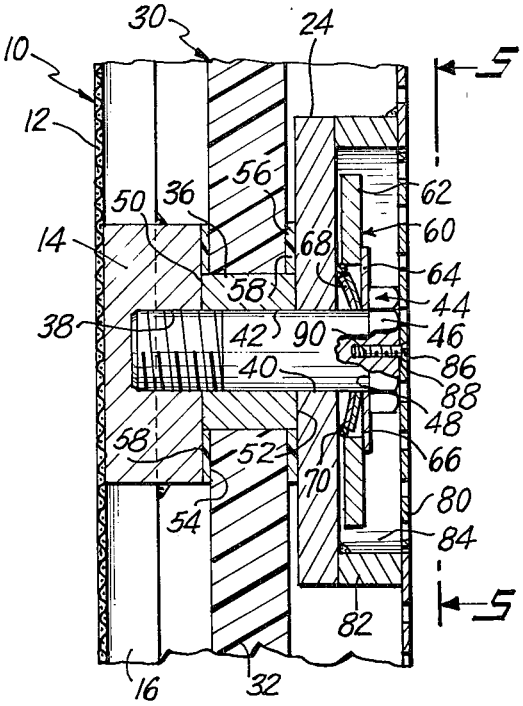
Fig. 4.
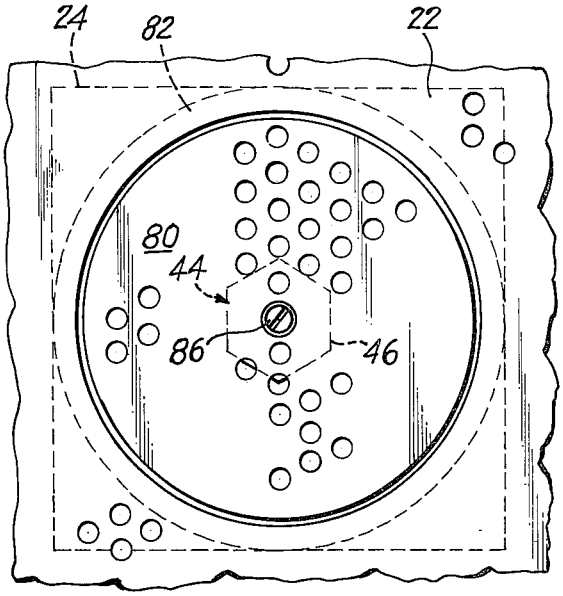
Fig. 5.
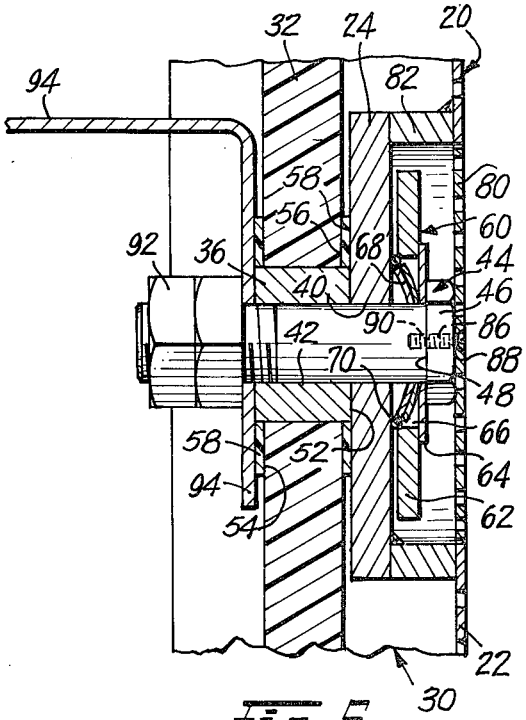
Fig. 6.
Fig. 7.
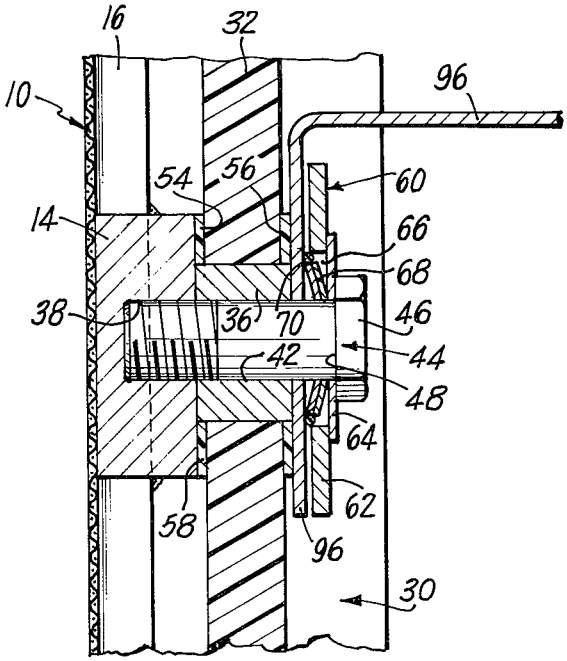

CELL CONNECTOR FOR BIPOLAR ELECTROLYZER

BACKGROUND OF THE INVENTION

1. Field of the Invention

The present invention relates, generally, to cell connectors for insuring direct electrical communication and positive mechanical connection with a cell in a bipolar permselective membrane electrolyzer, while precluding fluid and gaseous flow therefrom. More particularly, the present invention relates to an intercell connector for bipolar permselective membrane electrolyzers utilized for the electrolysis of sodium chloride brine in the production of chlorine and caustic soda.

2. Description of the Prior Art

The electrolysis of sodium chloride brine is by far the most important commercial process for producing chlorine and caustic soda. Recently, there has been tremendous commercial interest in electrolysis cells incorporating metallic anodes, rather than graphite anodes used theretofore, for this process. Further along these lines, there is evolving a clear trend toward the use of cationic permselective membranes, and away from the formerly conventional permeable deposited asbestos diaphragms employed in these cells. The permselective membranes differ substantially in nature from the permeable diaphragms in that no hydraulic flow from anode to cathode compartments is permitted. The permselective membranes, typically ion exchange resins cast in the form of a very thin sheet, consist of a perfluorinated organic polymer matrix to which ionogenic sulfonate groups are attached. Thus, during electrolysis of sodium chloride brine, the negatively charged groups permit transference of current-carrying sodium ions across the membrane while excluding chloride ions. Consequently, it is now possible to produce caustic soda of a predetermined concentration, and one nearly free of chloride, within the cathode compartment due to these ionic constraints imposed upon the system.

Maximum utility of a system incorporating metallic anodes and permselective membranes is achieved by a multi-cell design wherein cells are arranged in serial fashion. While such a design takes full advantage of the characteristics of these bipolar, permselective membrane electrolyzers, a particularly troublesome problem arises in effectively providing direct electrical communication and positive mechanical connection between the various cells, as well as to the external source of electrical power employed for electrolysis. That is, while the membrane itself does not permit gross hydraulic flow between the various compartments, the art has encountered substantial difficulties in minimizing fluid and/or gaseous flow between compartments at the various intercell connection locations.

Certain cell and intercell connectors have been proposed to minimize the leakage problem from or between cells while yet insuring good mechanical and electrical contact. These connectors routinely incorporate sealing devices including gaskets, O-rings, and the like. See, for example, U.S. Pat. Nos. 3,752,757, 3,788,966, 3,824,173, 3,902,985, 3,915,833, 3,950,239, and 3,970,539. However, it is found that those devices which maximize mechanical connection with an eye toward minimizing fluid or gaseous leakage between cells often sacrifice optimum electrical communication. On the other hand, those devices maximizing electrical communication are found to be less than totally efficient in minimizing fluid and/or gaseous leakage, due to, for example, corrosive degradation of the components or inherent design problems.

Accordingly, the need exists to provide a cell connector, particularly an intercell connector, for a bipolar permselective membrane electrolyzer which maximizes both mechanical connection and electrical communication between the cells while substantially precluding fluid and/or gaseous flow.

SUMMARY OF THE INVENTION

In accordance with the aforementioned deficiencies in prior art intercell connectors, it is a primary object of the present invention to provide an intercell connector which maximizes both electrical communication and mechanical connection between the cells in a plural cell, bipolar permselective membrane electrolyzer.

Another object of the present invention is to maximize electrical communication between an anode and a cathode in adjacent cells of a bipolar permselective membrane electrolyzer by the application of an appropriate, substantially constant, compressive force at the electrical interfaces between electrode bosses and a conductive insert provided in the cell-separating web.

Still another object of the present invention is to substantially preclude fluid and/or gaseous flow between adjacent anode and cathode compartments through the intercell connector of a bipolar permselective membrane electrolyzer.

In accordance with the present invention, it has now been determined that the aforementioned objects may be realized by a design which includes an electrically conductive insert disposed within an aperture in the web separating adjacent cells, the insert defining anode and cathode interfaces at locations of planar contact with an anode boss and a cathode boss respectively, these interfaces being maintained in a state of constant, predeterminable compressive force. The electrically conductive insert is, preferably, a copper tube having a bore therein. The anode boss is formed of a valve metal, preferably titanium, and has a blind threaded bore therein which corresponds dimensionally with the bore in the insert. The cathode boss also has a corresponding bore through its thickness, and is recessed from the cathode. A fastening member is disposed through the bores in each of the cathode boss and copper insert and into mating engagement with the, preferably, threaded blind bore in the anode boss, and provides axial compressive force at the anode and cathode interfaces with the insert. A biasing member is interposed between the fastening member and the cathode boss for providing a force in opposition to the axial compressive force, which insures a constant compressive force at these interfaces.

Various seals are provided to insure fluid and gaseous integrity of the connector. Preferably, these seals comprise elastomeric gaskets at the periphery of the anode and cathode interfaces with the conductive insert, and elastomeric O-rings disposed proximate the biasing member.

Other objects and advantages of the present invention will become apparent upon examination of the following detailed description of the invention, taken in conjunction with the Figures of Drawing, wherein:

BRIEF DESCRIPTION OF THE INVENTION

FIG. 4 is a sectional view, taken substantially along the line 4—4 of FIG. 1, showing an intercell connector in accordance with the present invention;

FIG. 5 is an end view of the intercell connector, showing a cathode cover;

FIG. 6 is an elevation view of an end cell connector for external electrical communication with a cathode; and, FIG. 7 is an elevation view, similar to FIG. 6, of an end cell connector, showing external electrical connection for an anode.

DETAILED DESCRIPTION OF THE INVENTION

In order to more fully elucidate upon the various objects and advantages of the present invention, the following detailed description will be given in terms of various preferred embodiments thereof. However, the same are intended to be illustrative only, and in no wise limitative.

The cell connectors of the present invention are specifically designed for use in conjunction with a plural cell, bipolar, permselective membrane electrolyzer. These cell connectors are adapted for use in such an electrolyzer which receives an input of sodium chloride brine for the conversion thereof to chlorine and caustic soda. Accordingly, the various components are chosen, from a design and materials' viewpoint, with this highly corrosive environment borne in mind. Also, the design is one which particularly accounts for the desirability of precluding fluid or gaseous flow between adjacent anode and cathode compartments within the electrolyzer.

Figure 1:
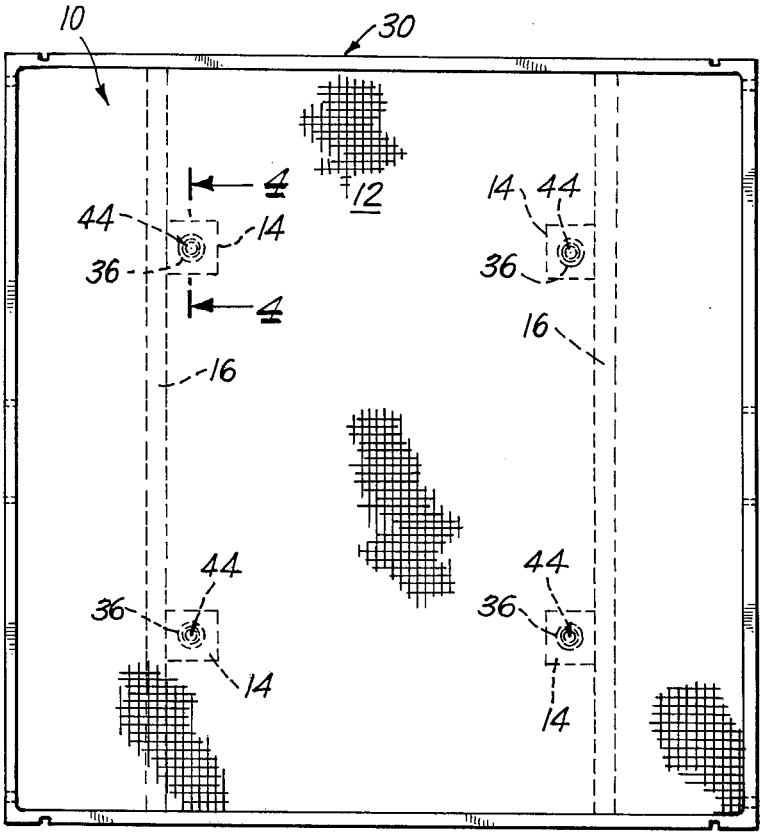
FIG. 1 is an elevation view of an anode bearing four anode bosses.

FIG. 1 shows an anode, designated generally as 10, including an anode web 12 typical of those used in bipolar permselective membrane electrolyzers. The anode is, conventionally, comprised of a metal which is resistant to the products generated within the anode compartments, typically a valve metal. The valve metals, sometimes referred to as "film-forming metals", are those which form an oxide film when exposed to acidic media or under certain anodic polarization conditions; i.e., the valve metals are known to passivate under these anodic polarization conditions. Thus, the anode substrate may be selected from the group of metals including titanium, zirconium, hafnium, vanadium, niobium, tantalum, and tungsten. For considerations of economics and ease of availability, the metals titanium, tantalum, and tungsten are most often employed, titanium being the most preferred. However, other titanium alloys exhibiting similar anodic polarization characteristics may equally be utilized.

To be useful, the valve metal substrate is coated with an electroconductive/electrocatalytic material possessed of a low chlorine overvoltage. The art recognizes numerous coatings, primarily predicted upon the noble metals, alloys, and oxides thereof. Thus, the active electrode coating can include ruthenium, rhodium, palladium, osmium, irridium, and platinum. To minimize cost, the noble metal or noble metal oxide may be compounded or mixed with an electroconductive diluent. See, for example, U.S. Pat. No. 3,701,724.

Regardless of the absolute materials from which the anode is fabricated, the anode web 12 is provided with upstanding anode bosses 14, four of which are shown in FIG. 1, for mechanical connection of the anode within the cell. The bosses may be fabricated from the same metal or alloy as that of the anode substrate; titanium being most preferred. Attachment of the bosses to the anode may be made by, e.g., welding. Because the anode web 12 is conventionally a mesh structure, to maximize the amount of surface area available for contact during electrolysis, electrically conductive rods 16 are included to assist in distributing electrical current throughout the mesh and to render the anode more rigid.

Figure 2:
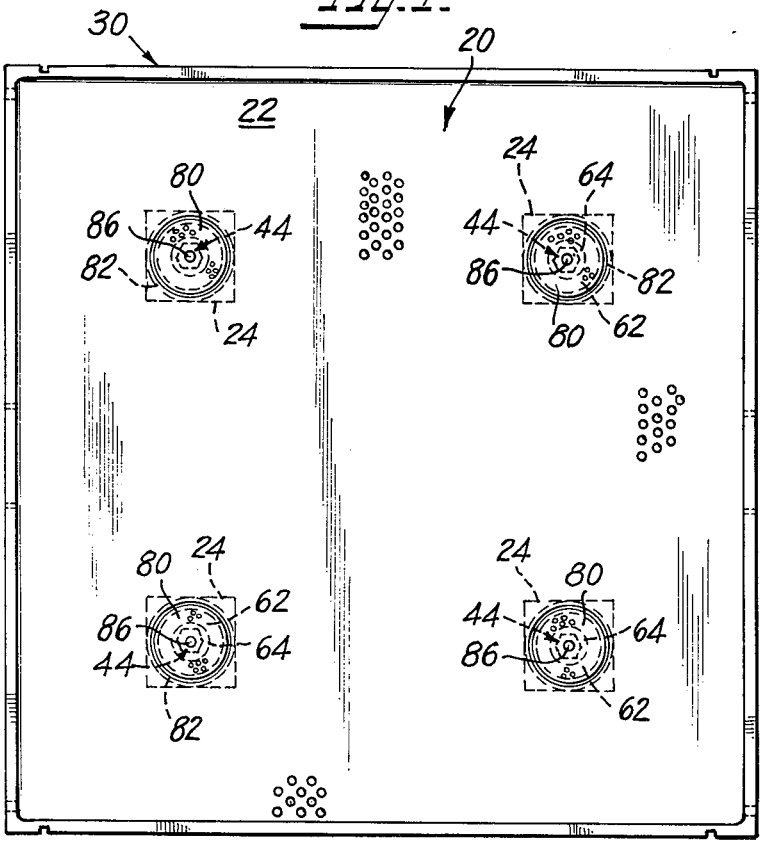
FIG. 2 is an elevation view of a cathode having four cathode bosses.

FIG. 2 shows a cathode structure, designated generally as 20, suitable for use in the electrolyzer, and which is comprised of a cathode web 22. The material from which the cathode web 22 is fabricated should be one which is also electroconductive and which is resistant to, particularly, hydroxyl ions. Typically, the cathode will be fashioned from a metal selected from the group consisting of iron, steel, cobalt, nickel, manganese, and the like; iron and steel being most preferred. The cathode of FIG. 2 is also provided with bosses 24, for mechanical connection in the electrolyzer cell. Again, four such bosses are illustrated in FIG. 2, the physical locations corresponding to those of the anode bosses 14 of FIG. 1. No rods serving as current distributors or stiffeners are required for the cathode web 22, as the same is substantially more rigid than the mesh anode web 12 and possesses substantially greater electric current carrying ability. As shown, cathode webb 22 is a perforated sheet; albeit, the cathode might well be in the form of a plate, or a foramanous or expanded metal.

Figure 3:
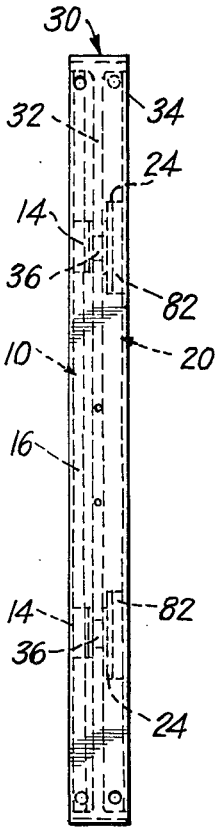
FIG. 3 is a side elevation view of a cell frame separator.

FIG. 3 shows a side elevation view of an intercell separator, 30, with the anode 10 and cathode 20 separated by means of a center web 32 retained with a frame member 34. The anode boss 14 and cathode boss 24 mate in opposition across the web 32, with an electrically conductive insert 36 interposed therebetween. The separator 30 is fabricated from materials known to be chemically inert in the environment within the electrolyzer, and also electrically non-conductive. Thus, the web 32 might be made from polypropylene, polyethylene, polybutadiene, polyvinyl acetate, polyesters, etc.; polypropylene being most preferred.

FIG. 4 shows one of the intercell connectors in greater detail. As shown in FIG. 4, the anode boss 14 is formed with a blind threaded bore 38. The cathode boss has a corresponding through bore 40, while the electrically conductive insert 36 has a bore 42. Preferably, the insert 36 is a copper tube or bushing. A fastener, 44, is inserted through the bores in the cathode boss, tubular insert, and into mating engagement with the threaded bore in the anode boss. The fastener 44 is, most advantageously, a standard steel or ferrous alloy bolt having a head 46 and shoulder 48.

Where the anode boss 14 meets the face of insert 36, there is defined an anode interface 50 peripherally about bolt 44. Likewise, a cathode interface 52 is formed where cathode boss 24 mates with the insert 36. Because each of the anode and cathode bosses has a transverse dimension greater than that of the insert 36, there are also formed an anode/web interface 54 and a cathode/web interface 56, respectively. To preclude fluid and gaseous flow across the connector, gaskets 58 are provided at the electrode/web interfaces 54, 56. These gaskets may be fabricated from various chemically resistant materials, among which might be mentioned rubber, chlorinated plastics, polypropylene, polymers and copolymers of trifluorochloroethylene, tetrachloroethylene, tetrafluoroethylene, polyvinyl acetate, polyesters, etc., with or without fillers such as, e.g., asbestos. The selection of appropriate gasket materials is well within the purview of the skilled artisan. When the bolt 44 is tightened within the threaded bore 38, an axial compressive force is exerted which compresses the gaskets 58 at the interfaces 54, 56, to insure a fluid and gas tight connection. The degree of compression may be appropriately adjusted by use of, e.g., a torque wrench, or may simply be limited by the depth of blind threaded bore 38. To further insure proper sealing, it is desirable that the axial dimension of insert 36 is slightly greater than the thickness of center web 32.

In order to assure the maintenance of a low resistance electrical path, it has been found essential to maintain a constant compressive force on the electrode interfaces 50 and 52. Thus, in conjunction with the axial force applied by bolt 44, there is provided a biasing force in opposition thereto. This opposing force is achieved by a biasing device, designated generally as 60 in FIG. 4.

The biasing member 60 includes a bolt head skirt 62, which, in combination with a washer 64 resting against the shoulder 48 of bolt 44, defines an annular channel 66. Disposed within this channel is a biasing spring member 68, which might be simply a spring washer. In order to effectuate a fluid and gas tight seal, an O-ring 70 is included within the annular channel 66 about the circumferential periphery of spring 68. This O-ring may be of a material selected from the same group of materials for the gaskets 58.

A cathode bolt cover 80 is provided to present an uninterrupted cathodic surface to the catholyte. A plan view of the cathode bolt cover 80 is shown in FIG. 5. As shown in FIG. 4, the cathode boss 24 is provided with an upstanding terminal ring 82, the height of which corresponds substantially to the projection of the head of bolt 44. While the ring 82 is shown as circular in this embodiment, obviously any other geometrical configuration would work equally as well. The cathode 22 terminates at the inner edge of ring member 82, thereby yielding a recess 84. The cathode bolt cover 80 is formed from the same material as that of the cathode 22, e.g., steel, and is shaped to have a complementary geometrical configuration with respect to that of member 82. The dimension of bolt cover 80 is also complementary to that of ring member 82 in order that the cover mates in loosely sealing engagement therewith.

The bolt cover 80 is attached to the bolt 44 by means of a screw or bolt 86 which passes through an aperture 88 in the bolt cover and into engagement with a blind threaded bore 90 in bolt 44. The aperture 88 is appropriately countersunk such that the head of bolt 86 is flush with the surface of the bolt cover 80.

FIGS. 6 and 7 illustrate end connectors similar to the intercell connector of FIG. 4, and wherein like parts are designated with the same reference numerals. The end cell connector of FIG. 6 is that for the cathodic terminal of the electrolyzer and, thus, the fastener or bolt 44 terminates in a locking nut 92. A bus bar 94 mates with the insert 36 for electrical communication and, otherwise, the structure is identical with the cathodic portion of the intercell connector shown in FIG. 4.

FIG. 7 illustrates the end cell connector for the anodic side of the electrolyzer. Accordingly, the fastener 44 captures an anodic bus bar 96 in proximate contact with the insert 36. Otherwise, the end cell connector of FIG. 7 is identical to the anodic portion of the intercell connector of FIG. 4.

From the foregoing, it is evident that both the mechanical connection and electrical communication either between cells (i.e., intercell) or at the terminal cells (i.e., end cell) are maximized. Fluid and gaseous integrity are maintained by virtue of the O-ring seals and elastomeric gaskets at all points at which fluid or gas might otherwise penetrate the connector. Mechanical connection is positive by virtue of the design of the bolt 44 in combination with the electrode bosses 14 and 24, along with the insert 36. Due to materials' selection and the effect of the biasing member 60, electrical conductivity across the connector is maintained, whereby a low resistance electrical path is established.

What is claimed is:

1. A cell connector adapted for insuring direct electrical communication and mechanical connection with a cell in a bipolar permselective membrane electrolyzer while precluding fluid and gaseous flow therefrom, comprising:

(a) an electrically non-conductive cell web;

(b) an electrically conductive insert having a bore therein disposed in an aperture in said web;

(c) an electrode boss bearing a cell electrode on a first face thereof and disposed adjacent said insert at a second face thereof defining an electrode interface, said boss including engaging means proximate said bore;

(d) electrically conductive fastening means disposed through said bore and received in mating cooperation with said engaging means, said fastening means provided an axial compressive force at said interface; and (e) biasing means in operative engagement with said fastening means for providing force in opposition to said axial compressive force.

2. An intercell connector as defined in claim 1, adapted for insuring direct electrical communication and mechanical connection between adjacent cells in a plural cell bipolar permselective membrane electrolyzer while precluding fluid and gaseous flow therebetween, wherein:

(a) said web defines means for separating an anode compartment from an adjacent cathode compartment;

(b) said electrode boss is an anode boss bearing an anode on a first face thereof and said interface is an anode interface; and, (c) said engaging means includes a blind threaded bore; said intercell connector further comprising:

(d) a cathode boss bearing a cathode on one face thereof and disposed adjacent said insert at a second face therof defining a cathode interface, said cathode boss including a bore for receiving said fastening means therethrough.

3. The intercell connector of claim 2, wherein the transverse dimensions of each of said anode and cathode bosses are greater than the transverse dimension of said insert thereby defining an anode/web interface and a cathode/web interface; said intercell connector further comprising elastomeric gaskets at each of said anode/-web and cathode/web interfaces.

4. The intercell connector of claim 3, wherein:

(a) said fastening means comprises an electrically conductive bolt having a shoulder formed thereon; and, (b) said biasing means comprises a spring member disposed intermediate said shoulder and said cathode boss.

5. The intercell connector of claim 4, wherein said spring member comprises a spring washer retained within an annular channel bounded circumferentially by a bolt head skirt disposed intermediate said shoulder and said cathode boss, said intercell connector further comprising an elastomeric O-ring disposed within said channel in sealing engagement therewith.

6. The intercell connector of claim 5, wherein:

(a) said cathode boss includes an upstanding ring member at the periphery thereof; and, (b) said cathode terminates at the boundary of said ring member thereby defining a recess for receiving said fastening means, the depth of said recess corresponding substantially to the projection of said bolt from said cathode boss; said intercell connector further comprising:

(c) a cathode bolt cover having a complementary geometrical configuration with respect to said ring member and having a dimension for receipt in loosely sealing engagement therewith, said cover including an aperture therein;

(d) a blind threaded bore in the head of said bolt in registration with the aperture in said cover; and, (e) cover fastening means for securing said cover to said bolt, whereby a substantially uninterrupted cathode surface is presented.

7. The intercell connector of claim 6, wherein said anode boss is formed from a valve metal.

8. The intercell connector of claim 7, wherein said valve metal is titanium or an alloy having similar anodic polarization characteristics.

9. The intercell connector of claim 6, wherein the longitudinal dimension of said insert is slightly greater than the thickness of said web.

10. The intercell connector of claim 9, wherein said insert is a tubular copper insert and said bolt is a ferrous alloy bolt.

* * * * *